US007003908B2

(12) United States Patent
Bober et al.

(10) Patent No.: US 7,003,908 B2
(45) Date of Patent: Feb. 28, 2006

(54) SELF-ERECTING DEVICE

(75) Inventors: Andrew M. Bober, Racine, WI (US); Chad C. Chapman, Westminster, CO (US); Erik C. Gilbert, Charlotte, NC (US); James M. Scolaro, Racine, WI (US); Weston J. Sylvester, Charlotte, NC (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/904,281

(22) Filed: Nov. 2, 2004

(65) Prior Publication Data

US 2005/0056202 A1 Mar. 17, 2005

Related U.S. Application Data

(63) Continuation-in-part of application No. 10/249,932, filed on May 20, 2003, now abandoned.

(51) Int. Cl.
*G09F 15/00* (2006.01)

(52) U.S. Cl. ..... 40/610; 116/63 R

(58) Field of Classification Search ..... 40/610, 40/612; 116/63 C, 63 R
See application file for complete search history.

(56) References Cited

U.S. PATENT DOCUMENTS

| | | | | | |
|---|---|---|---|---|---|
| 2,762,327 | A | | 9/1956 | Weig | 116/63 |
| 2,808,803 | A | * | 10/1957 | Weig | 40/612 |
| 3,113,551 | A | | 12/1963 | Korn | 116/63 |
| 3,250,241 | A | | 5/1966 | Levy et al. | 116/63 |
| 3,707,320 | A | | 12/1972 | Brynes | 350/97 |
| 3,720,181 | A | | 3/1973 | Elkins | 116/63 |
| 3,892,081 | A | | 7/1975 | Goral | 40/214 |
| 4,705,050 | A | | 11/1987 | Markham | 128/749 |
| 4,817,647 | A | | 4/1989 | Nelson | 134/40 |
| 4,929,214 | A | | 5/1990 | Liebermann | 446/221 |
| 5,270,089 | A | | 12/1993 | Alston et al. | 428/60 |
| 5,506,040 | A | | 4/1996 | Cordani | 428/218 |
| 5,549,945 | A | | 8/1996 | Lind | 428/35.5 |
| 5,597,418 | A | | 1/1997 | Evans, Jr. et al. | 134/6 |
| 5,834,104 | A | | 11/1998 | Cordani | 428/220 |
| 5,888,016 | A | * | 3/1999 | Ahn | 40/612 |
| 5,941,752 | A | | 8/1999 | Liebermann | 446/220 |
| 6,177,164 | B1 | | 1/2001 | Sullens et al. | 428/40.1 |
| 6,338,213 | B1 | | 1/2002 | Young et al. | 40/610 |

FOREIGN PATENT DOCUMENTS

| | | |
|---|---|---|
| DE | 2 017 806 | 10/1971 |
| JP | 200364626 | 3/2003 |

* cited by examiner

*Primary Examiner*—Lars A. Olson
(74) *Attorney, Agent, or Firm*—Neil E. Hamilton; James J. Sales; Renee J. Rymarz

(57) ABSTRACT

A self-erecting device which can serve as a signaling unit. An absorbent pad connected to a self-erecting device results in a combined signal and spill absorbing unit. The self-erecting and absorbing device is simple in construction and easy to operate. In an alternative embodiment, the self-erecting device can include a carpet cleaner in the absorbent pad.

54 Claims, 6 Drawing Sheets

SELF-ERECTING DEVICE

BACKGROUND OF THE INVENTION

Technical Field

This invention relates to a self-erecting signal device. More particularly, it relates to a self-erecting signal device which is particularly suited for signaling spills or spots on floors so as to serve as a warning.

Inflatable signaling devices are well-known. These are disclosed in U.S. Pat. Nos. 2,762,327; 3,113,551; 3,250,241; 3,707,320; 3,720,181 and 3,892,081.

Self-inflatable enclosures are disclosed in U.S. Pat. Nos. 4,929,214 and 5,941,752.

Fluid absorbing mats are disclosed in U.S. Pat. Nos. 5,270,089; 5,506,040; 5,549,945; 5,597,418 and 5,834,104.

The prior art does not provide a self-erecting signaling device. Neither does it provide a self-erecting signaling device which is adaptable for use with a liquid absorbing mat.

There is a need for a self-erecting signaling device to indicate spills on a floor. These occur frequently in stores and particularly those which provide products which when dropped on a floor result in a liquid or slippery substance. This is a hazardous condition for shoppers as falls can occur. Not only is a self-erecting signaling device beneficial, it is even more useful if it is combined with an absorbing material which can absorb the spilled material.

The objects of the invention therefore are:

a) Providing a self-erecting signaling device.

b) Providing a self-erecting signaling device which is easily activated.

c) Providing a self-erecting signaling device of the foregoing type which is simple in construction and economical to produce.

d) Providing a self-erecting signaling device of the foregoing type which includes a fluid absorbing feature.

e) Providing a self-erecting signaling device of the foregoing type which can also include a cleaning function.

f) Providing a self-erecting signaling device of the foregoing type which is compact in design.

SUMMARY OF THE INVENTION

The foregoing objects are accomplished and the shortcomings of the prior art are overcome by the self-erecting device of this invention which in one embodiment includes a signal member, and an inflatable member. The signal member is connected to the inflatable member. A self-contained expandable member is present within the inflatable member, the inflatable member constructed and arranged to be inflated by the self-contained expandable member. A base member is constructed and arranged to support the outer member.

In another embodiment, the self-erecting device includes a base member constructed to rest on a surface. There is a gas generating member and an inflatable member in fluid communication with the gas generating element. A signal element is erected by the inflatable member.

In another embodiment, the base member includes an absorbent member constructed and arranged to absorb liquid and spills on a surface.

In a preferred embodiment the inflatable member is gas impervious material and of a tubular configuration when inflated, and the expandable member includes a first material and second material which when reacted produce a gas, the materials being separated by a breachable member.

In still another embodiment, the expandable member includes an expandable system comprised of a liquid and an expandable member which expands when contacted with the liquid, the first and second members being separated by a breachable member to provide contact between the liquid and the expandable member.

In a most preferred embodiment, the self-erecting device includes a base member, a signal member, a self-contained expandable member, and a gas impervious inflatable member having opposing ends, the gas impervious inflatable member connected at opposing ends to the signal member and the base member. The expandable member is positioned in the gas impervious inflatable member whereby when the expandable member is activated, the gas impervious member expands to an elevated position, and in turn expands the signal member to an elevated position.

In yet another embodiment, there is a combined cleaning and self-erecting device which includes a cleaning member including a pad of absorbent materials. There is a cleaning material contained in a breachable container, the breachable container is connected to the pad. A self-erecting device is connected to the pad.

In still another embodiment, there is a self-erecting warning device which includes a first expandable member and a second expandable member for expanding the first expandable member. The second expandable member is the sole means for expanding the first expandable member and there is a liquid source constructed and arranged to provide a liquid to expand the second expandable member.

There is also provided a method of cleaning up a spill on a floor while signaling its location which includes placing an absorbent member on the spill. The absorbent member is connected to a self-erecting device. The self-erecting device is activated to signal the location of the spill.

In a preferred manner the method includes employing a self-erecting device composed of an inflatable member having an expandable member having a first member composed of a liquid and a second member composed of an expandable member which expands when contacted with the liquid, the first and second members being separated by a breachable member. The breachable member being broken by adequate force to provide contact between the liquid and the expandable member.

In yet another preferred manner, a method of cleaning up a stain on a surface while signaling its location is provided which includes placing a pad member connected to a self-erecting device, the pad member connected to a sachet containing a stain removing substance on a stain and activating the self-erecting device and releasing the stain removing substances from the sachet and allowing the pad member saturated with the stain removing substance and attached to the self-erecting device to remain on the surface and alternatively repeating the above steps until the stain is removed.

These and still other objects and advantages of the invention will be apparent from the description which follows. In the detailed description below, a preferred embodiment of the invention will be described in reference to the full scope of the invention. Rather, the invention may be employed in other embodiments.

DETAILED DESCRIPTION

Figure 1:
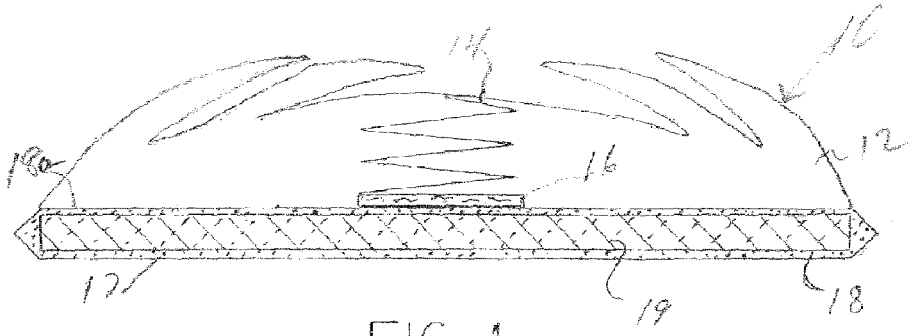
FIG. 1 is a side view of the self-erecting device of this invention.

Referring to FIG. 1, the self-erecting device of this invention generally 10 includes a flexible signal element or member 12 attached to a base member 17. Signal member 12 is composed of a plastic sheet which is preferably high density polyethylene. It is a flexible, expandable, pyramidal blanket which overlies the base member 17. It is of a pyramidal configuration when inflated. An inflatable member 14 is connected to the signal member 12 as well as the base member 17. Base member includes a lower fabric covering 18 and an upper fabric covering 18*a*. The lower fabric covering 18 and upper fabric covering 18*a* are composed of a nonwoven fabric comprised of 75% PET and 25% cellulose, Grade 12124 from Ahlstrom Fiber Composites. An absorbent core layer 19 is composed of a cellulose/super absorbent polymer composite core material from Gelok International Corp. as Gelok(r) 500/50 composite. It is entrapped in the nonwoven matrix of the fabric coverings 18 and 18*a*.

Figure 1A:
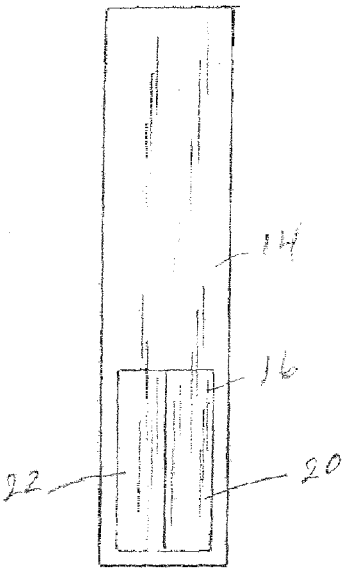
FIG. 1A is a side view of an inflatable member employed in the self-erecting device of FIG. 1.
Figure 1B:
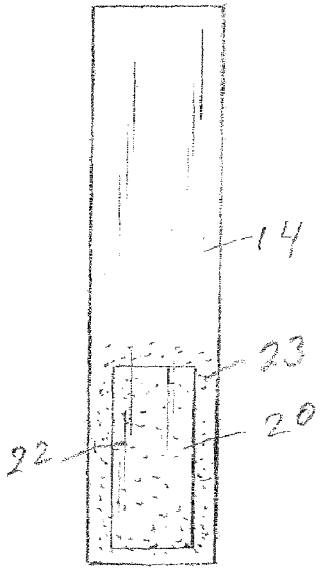
FIG. 1B is a view similar to FIG. 1A illustrating the activation of the inflatable member.

An expandable member 16 is placed inside the inflatable member 14. This is seen in FIGS. 1A and 1B. The inflatable member 14 is of a tubular configuration and contains two sachets 20 and 22. The inflatable member 14 is composed of a flexible polypropylene gas impervious plastic material as are the sachets 20 and 22. In the instance of the sachets, they contain components which when mixed together produce a gas. For example, sachet 22 can contain a carbonate or bicarbonate powder and sachet 20 an acid solution such as citric. These sachets 20 and 22 are constructed so they are breachable when a force is imposed so as to result in a mixing of the acid with the powder and produce carbon dioxide gas and provide an expandable member 16. This gas generating system is indicated in FIG. 1B with the carbon dioxide being indicated at 23.

Figure 2:
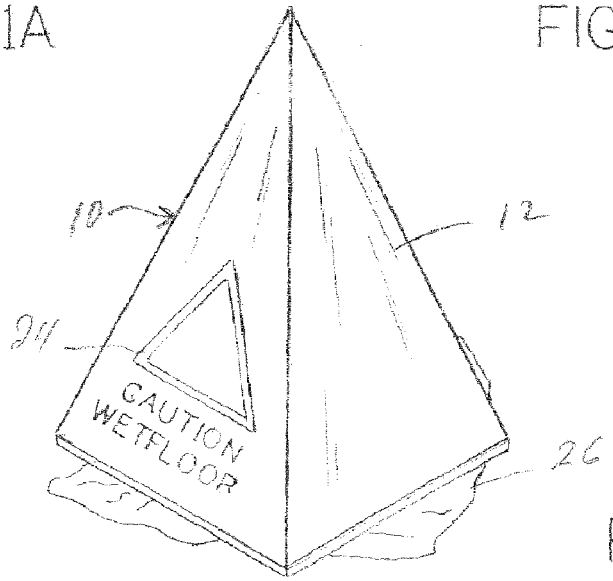
FIG. 2 is a perspective view of the self-erecting device of FIG. 1 in the erected state.
Figure 3:
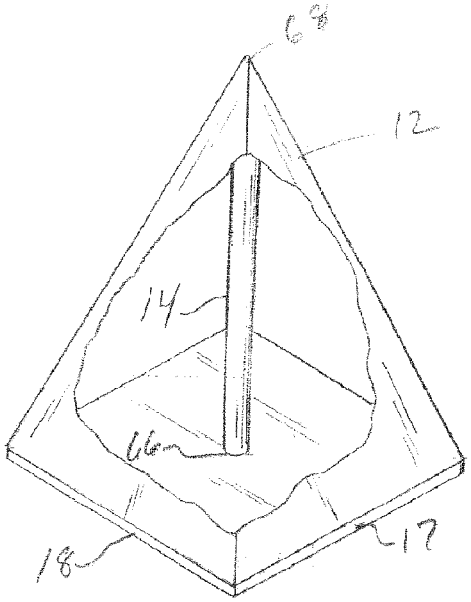
FIG. 3 is a view similar to FIG. 2 with a portion broken away to show the inflatable member.

In the following embodiments of FIGS. 4–9, the same parts are indicated with the same numbers as indicated in FIGS. 1–3.

Figure 4:
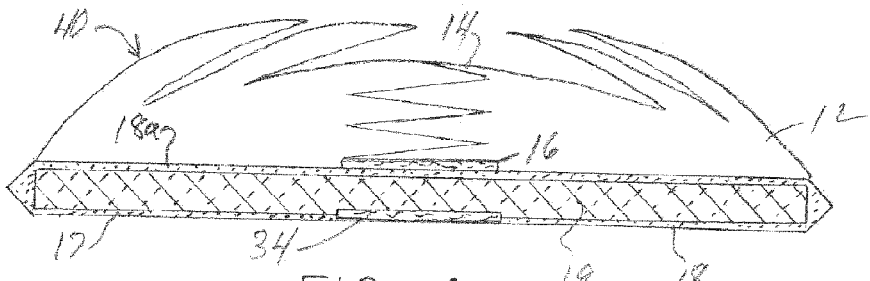
FIG. 4 is a view similar to FIG. 1 showing an alternative embodiment.

The FIG. 4 embodiment generally 40 is similar to embodiment 10 except that it additionally includes a frangible pad 34 which contains a carpet stain remover or a remover of stains on hard floors such as stone or terrazzo. The preferred stain remover is specific for the type of stain, either water-borne or oily. For water-borne spots and stains, the preferred stain remover is a 1% solution of sodium lauryl sulfate in water. For oily stains, the preferred stain remover is mineral spirits. The pad would be composed of a material similar to the sachets 20 and 22.

Figure 6:
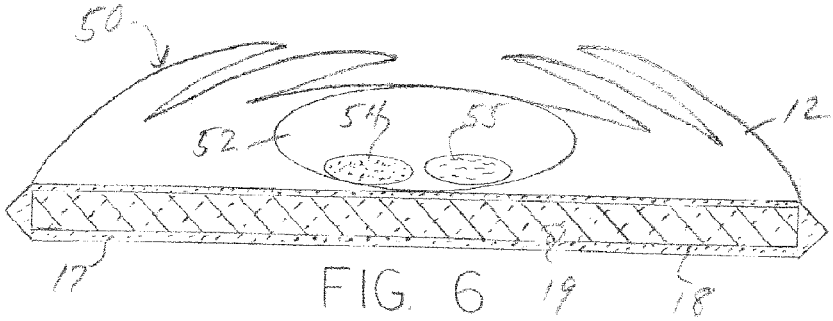
FIG. 6 is a view similar to FIG. 1 showing another embodiment.
Figure 7:
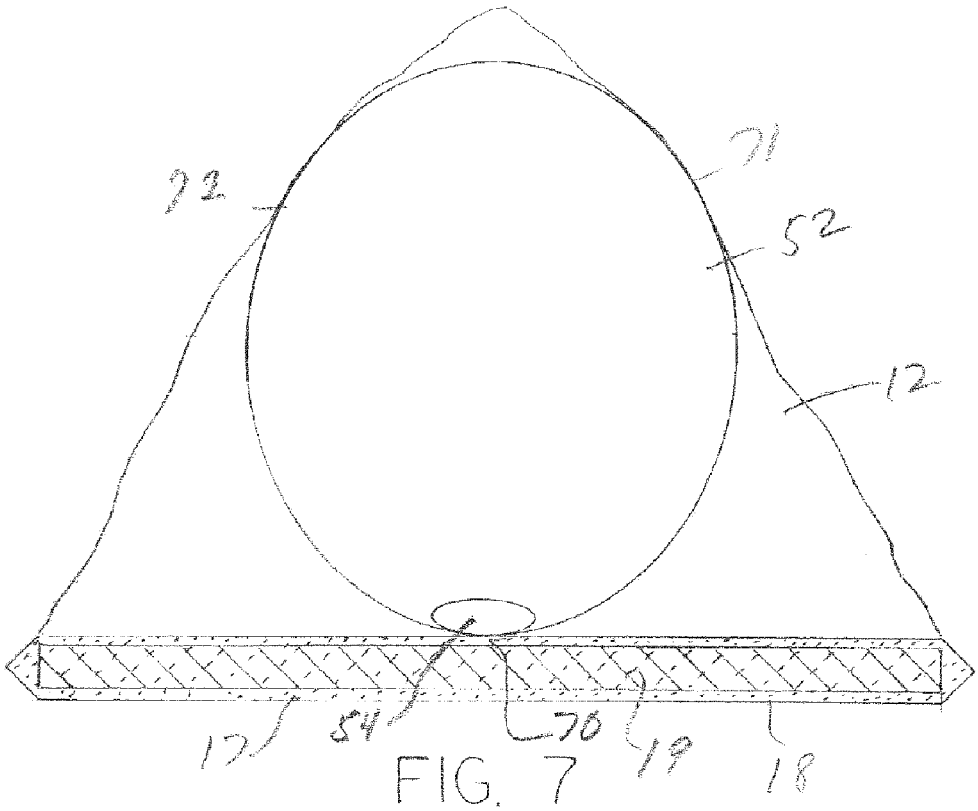
FIG. 7 is a view similar to FIG. 3 showing the FIG. 6 embodiment in an erected state.

FIG. 6 illustrates still another embodiment generally 50. In place of the previously described tubular inflatable member 14, there is a latex balloon 52 containing frangible sachets 54 and 55 which contain the previously described acid and powder.

Figure 8:
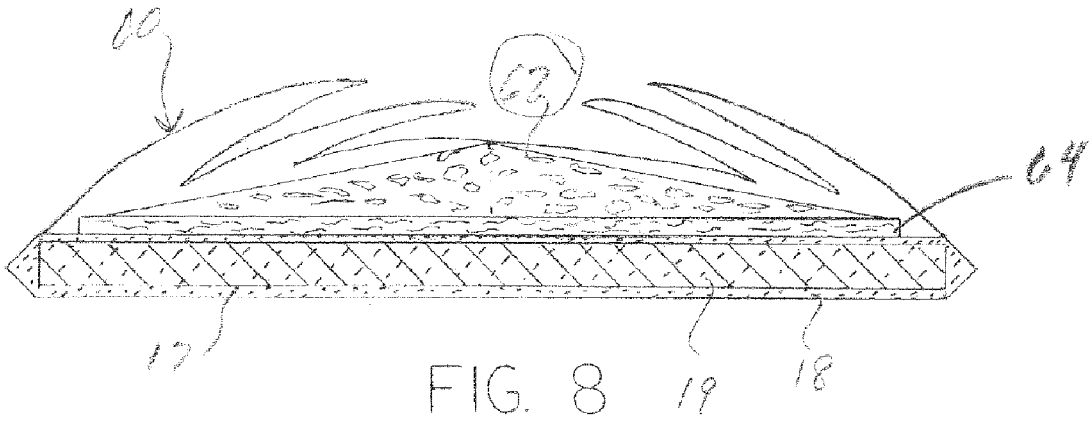
FIG. 8 is a view similar to FIG. 1 showing another embodiment.
Figure 9:
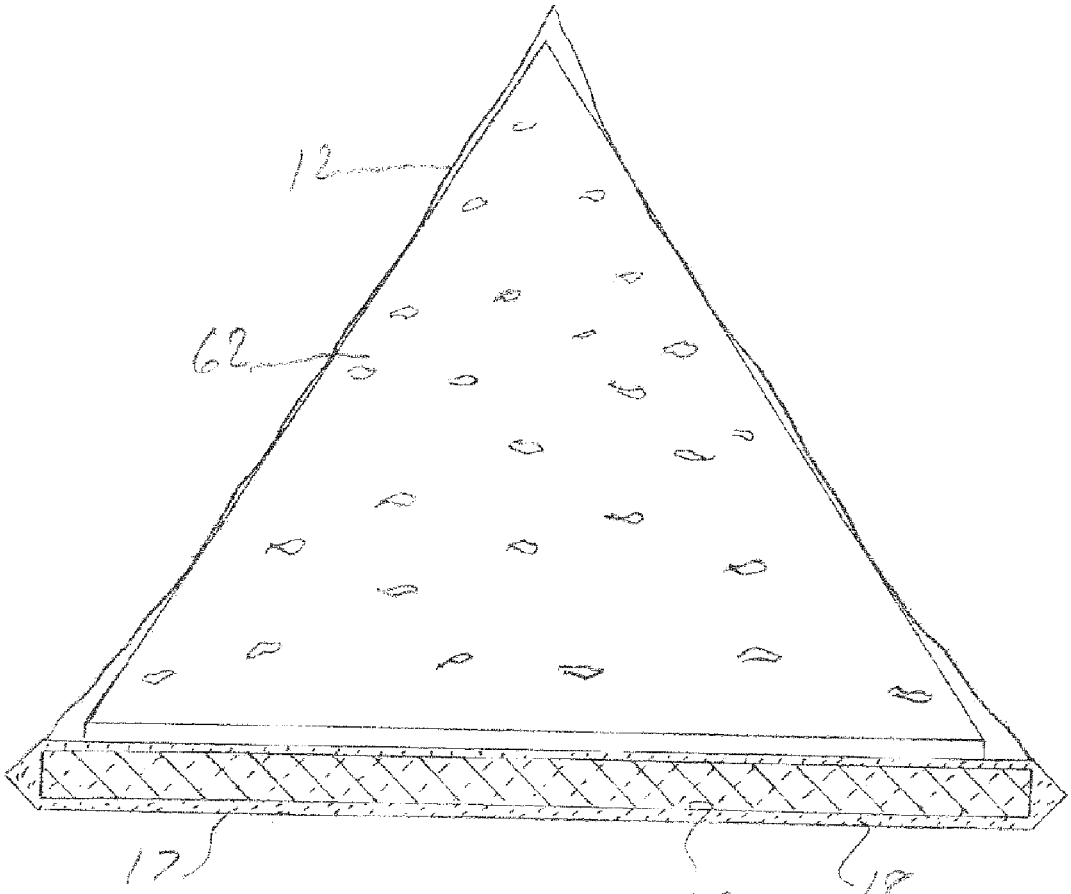
FIG. 9 is a view similar to FIG. 3 showing the FIG. 8 embodiment in an erected state.

FIGS. 8 and 9 show yet another embodiment generally 60. In place of the previously described tubular inflatable member 14 and the balloon 52, there is a sponge 62 with a frangible water sachet 64.

Figure 10:
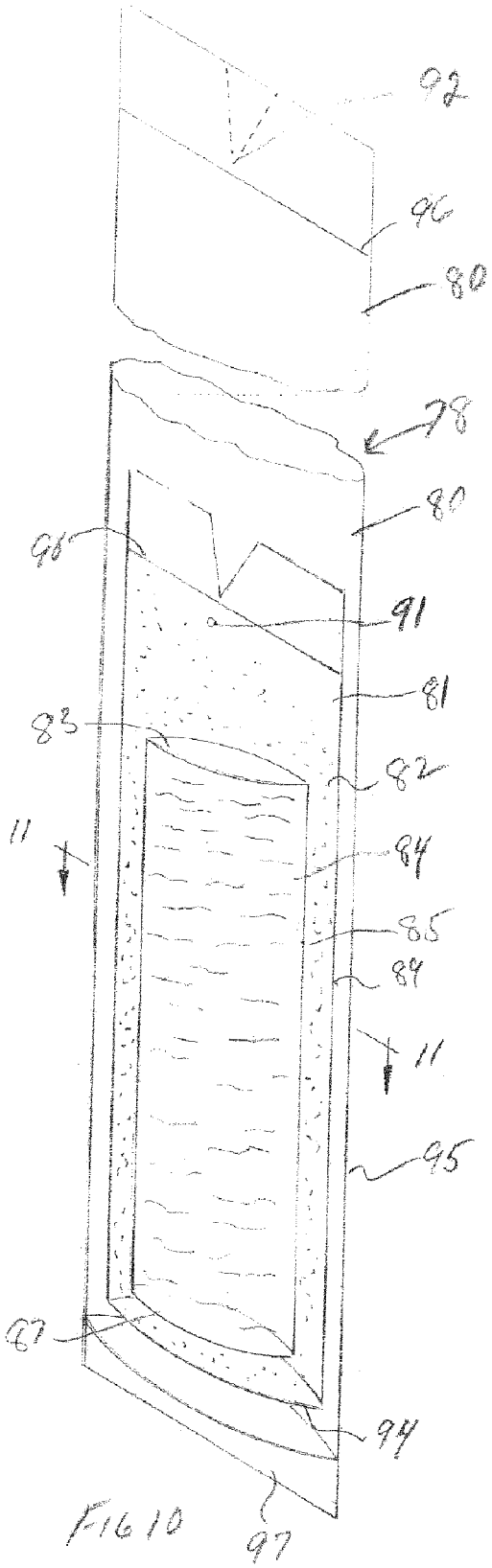
FIG. 10 is a view similar to FIGS. 1A and 1B showing a preferred embodiment.
Figure 11:
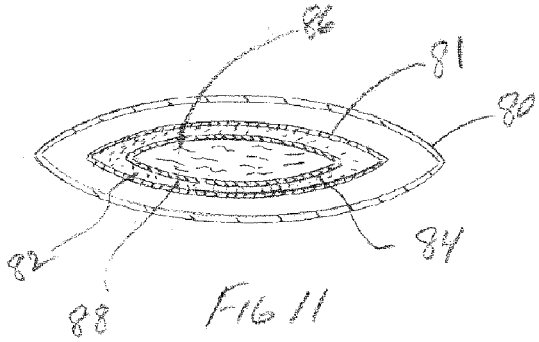
FIG. 11 is a sectional view taken along line 11—11 of FIG. 10.

FIGS. 10 and 11 illustrate another embodiment generally 78 with an inflatable member 80 and expandable member 81. In this instance, there is an inner sachet 84 containing water 86 and the outer expandable member 81 providing a compartment or sachet 82 for a powder 88 composed of sodium bisulfate and sodium carbonate. A pin hole 91 is located at one end of the sachet 82 for the purpose as later explained in the Operation. A precut or preweakened portion 92 is provided in the inflatable member 80 the purpose of which will also be later explained.

The preferred material for fabricating the inflatable member 80 is polypropylene. The expandable member 81 or sachet 82 is composed of high density polyethylene and sachet 84 is composed of low density polyethylene.

In a preferred manner, sachet 84 is heat sealed along its edges such as at 83 and 85 as well as at 87 where it is in turn sealed to sachet 82. It will be recognized that in the instance of seals 83 and 84, they are designed so that sachet 84 can be broken with hand or foot force to allow water 86 to escape and mix with powder 88. Sachet 82 is in a like manner sealed in a tubular manner along edges 89 and 90 as well as at 94 where it is sealed to sachet 84 as well as inflatable member 80. It will be seen that the inflatable member 80 is in turn sealed in tubular manner along its edges 95, 96 and 97.

Inflatable member 80 is heat sealed to the outer member 12 and base member 17 at its opposing ends such as along seals 96 and 97.

It will be recognized that inflatable member 14 as well as sachets 20 and 22 are sealed in a tubular manner such as previously described for inflatable member 80 and sachets 82 and 84. It is not necessary for the sachets 20 and 22 to be connected to the inflatable member 14.

Figure 12:
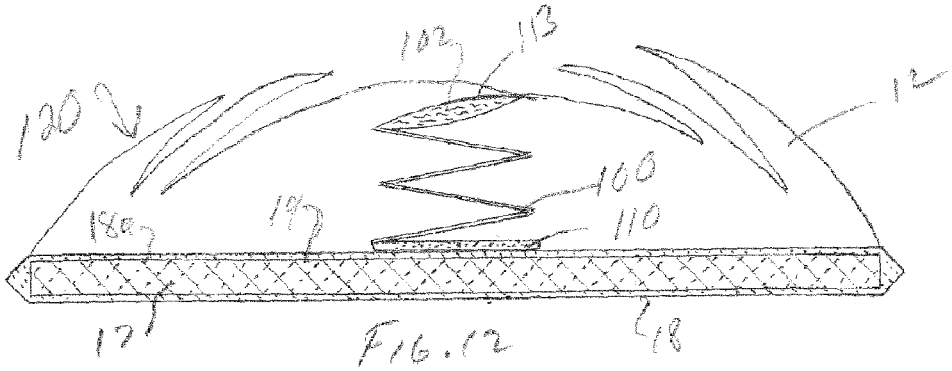
FIG. 12 is a view similar to FIG. 1 showing a preferred inflatable and expandable member for the self-erecting device.
Figure 13:
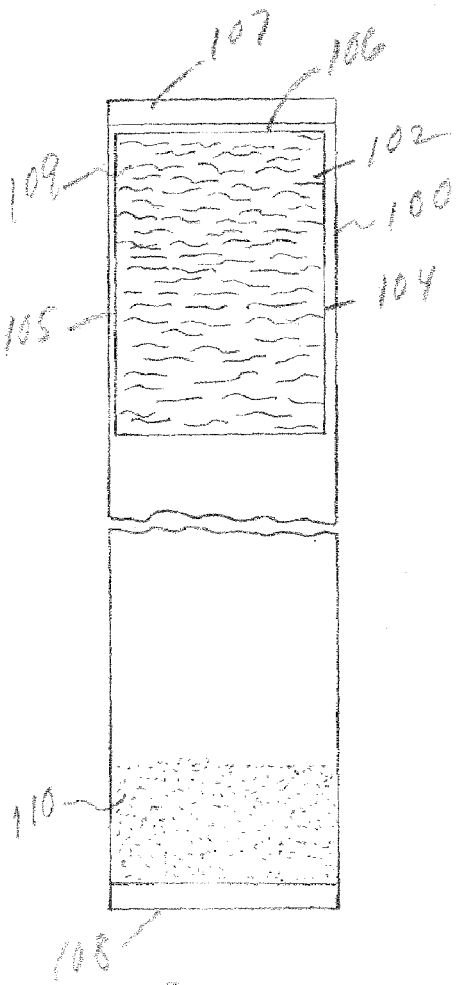
FIGS. 13 and 14 are side views of the preferred inflatable and expandable member shown in FIG. 12.
Figure 14:
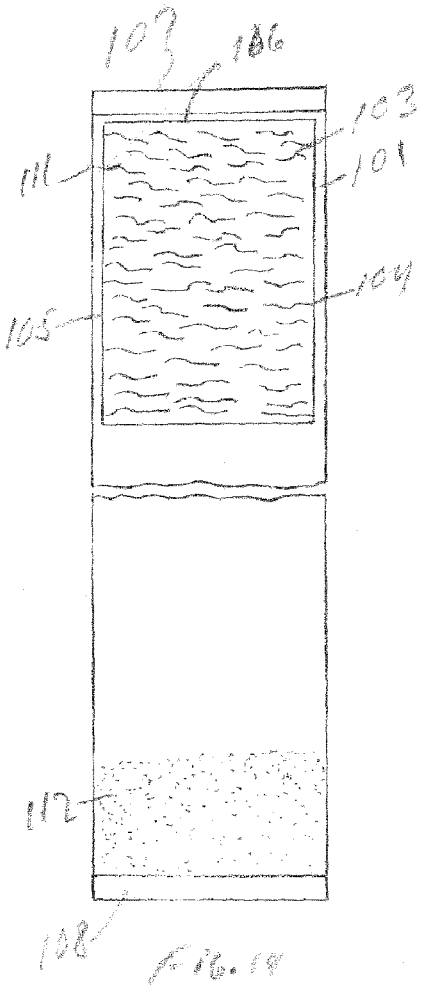

FIGS. 12–14 illustrate a preferred embodiment generally 120 of an inflatable member 100 and 101 and an expandable member. In both instances, sachets 102 and 103 are similar to previously described sachet 82 and are heat sealed along edges 104, 105 and 106. Sachets 102 and 103 are in turn sealed to inflatable members 100 and 101 in conjunction with seals 106. Unlike inflatable member 80, inflatable members 100 and 101 are blown in a tubular manner and sealed along edges 107 and 108. The preferred material for producing inflatable members 100 and 101 is polypropylene, whereas the preferred material for producing sachets 102 and 103 is a polyethylene terephthalate/polyethylene laminate.

Sachet 102 of inflatable member 100 is filled with an acid solution 109 composed of citric acid and water. A carbonate base material 110 such as sodium carbonate is loosely placed in inflatable member 100. Inflatable member 101 is similar to inflatable member 100 except for the materials in the sachet 103 and in the inflatable member 101. In place of the acid solution 109, water 111 is sealed in sachet 103 and an acid/carbonate powder blend 112 such as sodium bisulfate and sodium carbonate is placed in inflatable member 101. The acid solution 109 and base material 110, as well as the water 111 in combination with the acid/carbonate powder blend 112 provide expandable members for the inflatable members 100 and 101.

Referring to FIG. 12, inflatable member 100 is heat sealed to and centrally positioned with respect to the base member 17. At the opposite end inflatable member 100 and sachet 102 are heat sealed to the outer or signal member 12 by heat sealing a portion of the edge 107 or tag to the signal member 12. Inflatable member 100 is centrally positioned with respect to signal element 12. Inflatable member 101 is connected to base member 17 and signal element 12 in a similar manner.

Operation

A better understanding of the self-erecting devices of the invention will be had by a description of their operation. Referring to embodiment 10, it will be supplied in a collapsed condition as shown in FIG. 1. When a liquid spill is detected as indicated at 26 in FIG. 2, self-erecting device 10 is placed over the spill 26 and a force exerted on it such as by a foot. The force should be sufficient to fracture the sachets 20 and 22 and cause the citric acid solution and the carbonate powder to react. This is depicted in FIG. 1B with the carbon dioxide gas 23 evolving. As the gas evolves, it fills tubular inflatable member 14 causing it to rise and assume a pyramidal position as shown in FIG. 3. The inflatable member 14 functions in a manner similar to the center pole in a tent. It is connected centrally to base member 17 such as at 66 and at the inside of peak or apex 68 of the erected outer member 12. When placed over spill 26 in the erected position as seen in FIG. 2, it will serve as a warning device with the indicia 24. At the same time, the absorbent layer 19 in base member 17 absorbs the liquid spill 26. The absorbent layer 19 can be saturated with the spill.

Embodiment 40 functions in a similar manner as described for embodiment 110 except that this device 40 is designed for use on carpet spills or spills on stone or terrazo floors. In this instance, device 40 is placed over the spill and activated by the force of one's foot. This simultaneously activates the sachets 20 and 22 as well as sachet 34 which contains the stain remover.

Embodiments 50 and 60 function in a similar manner as previously described for embodiment 10. In embodiment 50, the two sachets 54 and 55 are similar to sachets 20 and 22 and when fractured result in carbon dioxide gas which fills balloon 52. This inflated balloon 52 assumes a position indicated in FIG. 7. Balloon 52 is connected to base member 17 such as at 70. It is also preferably connected to outer member 12 such as at 71 and 72, but such connections are not necessary.

Embodiment 60 is activated by fracturing the water sachet 64 which is composed of beachable polypropylene. The water causes the sponge 62 to expand to the position shown in FIG. 9. In this instance, the sponge 62 is connected to the sachet 64 which in turn is connected to the base member 17. The sponge 62 is preferably an open cell compressed cellulose material.

Embodiment 78 with inflatable member 80 and expandable member 81, function in the same manner as previously described for inflatable member 14 and expandable member 16. When the inner sachet 84 is breached, the water mixes with the powder 88 to form a gas and fill sachet 82 or expandable member 81. The gas escapes through pin hole 91 and fills inflatable member 80 to thereby cause the outer member 12 to erect. In order to deflate the inflatable member 80, it is torn open along the precut or weakened portion 92.

Embodiment 120 functions in essentially the same manner as previously described for inflatable member 14 and expandable member 16. The difference is in the manner of activation. With inflatable member 100 positioned in outer signal member 12 as shown on FIG. 12 and inflatable member 100 and signal member 12 essentially collapsed on base member 17, all that is required to activate embodiment 120 is to fracture sachet 102 to allow the acid solution to mix with the base materials 110. As indicated with the previous embodiment, this mixing causes a reaction of the acid solution and the base materials to produce carbon dioxide, causing the inflatable member 100 to assume an erected position as shown in conjunction with FIG. 3. Inflatable member 101 operates in the same manner.

The advantages of embodiment 120 over the previously described embodiments is with the sachet 102 positioned centrally near the top of the collapsed signal member 12, it is easily located form outside the signal member 12 and fractured.

Figure 5:
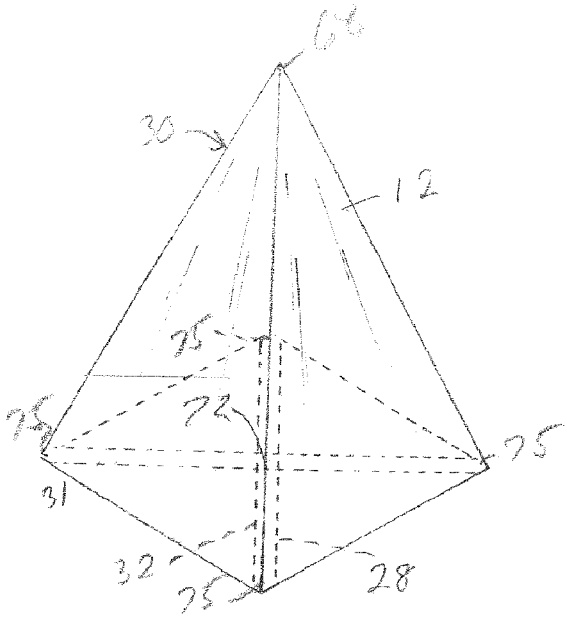
FIG. 5 is a view similar to FIG. 2 showing another embodiment.

The self-erecting devices 10, 40, 50, 60 and 120 have all been described with an absorbent base member 17. If desired, this can be eliminated so the self-erecting feature is provided for a warning device as shown in FIG. 5 with embodiment 30. In place of base member 17, there is provided two cross members 31 and 32 which are connected at their centers such as at 72. Outer member 12 is in turn connected at four positions 75 to the cross members 31 and 32. The preferred material for composing cross members 31 and 32 is rigid paperboard. Although not shown in embodiment 30, it will include the same inflatable member 14 which will be connected to the cross members 31 and 32 such as at 72 as well as inside peak 68.

It will thus be seen that there is now provided a self-erecting device which is simple in construction as well as fast and efficient to operate. The self-erecting device provides a combined cleaning and signal apparatus which is adaptable to a wide variety of spill conditions. The absorbent layer 19 can be customized to particular facilities to accommodate the particular products being handled.

The preferred system for creating carbon dioxide gas for inflating the inflatable member 14 in embodiment 10 is water and sodium bisulfate and sodium carbonate powder. Alternatively, other systems could be employed such as the following acids: hydrochloric acid, nitric acid, sulfuric acid, citric phosphoric acid, acetic acid, lactic acid, glycolic acid, sulfamic acid, formic acid or other water soluble organic or inorganic acids, as well as sodium bisulfite, or mixtures thereof which react with one or more of the following: lithium carbonate, lithium bicarbonate, sodium sesquicarbonate sodium carbonate, sodium bicarbonate, potassium carbonate, potassium bicarbonate, ammonium carbonate, ammonium bicarbonate, magnesium carbonate, calcium carbonate or other bicarbonates or carbonates, or mixtures thereof.

Certain preferred plastic materials for fabricating the outer member 12, inflatable member 14, sachets 20, 22, 54, 55, 64 and pad 34 have been previously indicated. However, other materials could be employed such as the outer member 12 could be low-density polyethylene, polypropylene, polyamide, woven or nonwoven cotton or synthetic fabric, paper, foil, or other materials capable of being formed into flexible sheets. The inflatable members 14, 80, 100 and 101 could be low-density polyethylene, high-density polyethylene, vinyl, nylon (polyamide), natural or synthetic rubber or other materials capable of being formed into a flexible, sealable tube which can then hold pressure upon inflation. The breakable sachets 20, 22, 54, 55, 64 and pad 34 could be low-density polyethylene, high-density polyethylene, vinyl, nylon (polyamide), and foil or foil laminates thereof or other materials capable of holding liquids with minimal permeation through the film. Sachets 82, 84, 102 and 103 could also be composed of the previously indicated materials other than polyethylene or the polyethylene terephthalate/polyethylene laminate. A certain preferred nonwoven fabric has been previously indicated for covering 18. Other fabrics such as a nonwoven fabric comprised of cellulose and/or polypropylene or polyethylene, heavyweight paper, or polymer reinforced paper can be used. In the instance of covering 18*a*, other materials such as a nonwoven or woven fabric or a liquid impervious layer such as aluminum foil, sheet polyethylene or propylene, could be employed. While a preferred material has been indicated for absorbent layer 19, other materials could be employed such as polypropylene or polyethylene fibers, cellulosic fibers, wood flour, sawdust, ground dried corncob, diatomaceous earth, ground pumice, dried clay, cat litter, vermiculite, synthetic clay, fumed silica, fuller's earth, or similar functional materials. Cross members 31 and 32 are composed of rigid paperboard. However, other materials could be employed such as wood, metal, corrugated paperboard, or any moldable plastic or plastic composites with sufficient thickness and strength to form a semi-rigid base. While certain preferred stain removers having been previously indicated for certain stains, others can be used such as combinations of detergents, builders, chelating agents, or solvents.

The unique self-erecting device has been described for use with spills. If desired, it can be employed in conjunction with any slippery condition such as wet mopped floors to signal a slippery condition.

What is claimed is:

1. A self-erecting device comprising:

a base member constructed to rest on a surface;

a gas generating member;

an inflatable member in fluid communication with the gas generating element; and a signal element which is erected by the gas generating member and the inflatable member.

2. A device of claim 1 wherein the inflatable member is in the signal member.

3. A device of claim 1 wherein the signal member is connected to the inflatable member.

4. A device of claim 1 wherein the signal member is a flexible, expandable, pyramidal blanket overlying to base.

5. A device of claim 1 wherein base includes liquid absorbent material.

6. A device of claim 1 wherein the gas generating member includes a sachet of dry gas generating powders and a sachet of water.

7. A device of claim 1 wherein the signal member is connected to the base and an apex of the inflatable member and rises over the base on inflation of the inflatable member.

8. A self-erecting device comprising:

a signal member;

an inflatable member, the signal member connected to the inflatable member;

a self-contained expandable member, the inflatable member constructed and arranged to be inflated by the self-contained expandable member, the signal element being erected by the self-contained expandable member; and a base member, the inflatable member connected to the base member.

9. The device of claim 8 wherein the base member includes an absorbent member constructed and arranged to absorb liquid and spills on a surface.

10. The device of claim 9 wherein the absorbent member is composed of layers of absorbent fabric.

11. The device of claim 9 wherein the absorbent member comprises a super absorbent material placed as a core between the layers of absorbent fabric.

12. The device of claim 11 wherein the super absorbent material is a super absorbent polymer entrapped in nonwoven matrix.

13. The device of claim 8 wherein the expandable member includes an expandable system comprised of a liquid and an expandable member which expands when contacted with the liquid, the first and second members being separated by a breacbable member to provide contact between the liquid and the expandable member.

14. The device of claim 13 wherein the liquid is water and the expandable member is a sponge.

15. The device of claim 8 wherein the expandable member includes water and a first material and second material which when mixed with the water react to produce a gas, the materials being separated by a breachable member.

16. The device of claim 15 wherein the first material is sodium bisulfate and the second material is sodium carbonate.

17. The device of claim 15 wherein the inflatable member is comprised of a gas impervious flexible material.

18. The device of claim 15 wherein the inflatable member is a latex balloon.

19. The self-erecting device as defined in claim 15 wherein the inflatable member comprises gas impervious material and wherein the inflatable member has a tubular configuration when inflated.

20. The device of claim 1 wherein the signal element is an outer member which is expanded to a pyramidal configuration.

21. The device of claim 20 wherein the signal member includes warning indicia.

22. A method of cleaning up a spill on a floor while signaling the spill employing the device of claim 9.

23. A method of cleaning up a spill on a floor while signaling its location comprising:

placing an absorbent member on the spill, the absorbent member connected to a self-erecting device, the self-erecting device including a signal element, the signal element erected by a self-contained gas generating member;

and activating the self-erecting device.

24. The method of claim 23 wherein the self-erecting device includes an inflatable member and an expandable member having a first member composed of a liquid and a second member composed of an expandable member which expands when contacted with the liquid, the first and second members being separated by a breachable member;

the breachable member being broken to provide contact between the liquid and the expandable member.

25. The method of claim 24 wherein the breachable member is broken by applying force.

26. The method of claim 23 wherein the self-erecting device includes an expandable member containing a first material and a second material which when reacted produce a gas, the materials being separated by a breachable member;

the breachable member being broken to provide contact between the first and second materials.

27. The method of claim 26 wherein the breachable member is broken by applying adequate force.

28. The method of claim 26 wherein a super absorbent material is placed on top of the absorbent member.

29. A combined absorbent member and self-erecting device comprising:

an absorbent member constructed and arranged to absorb substances on a surface; and a self-erecting device connected to a self-contained expandable member constructed and arranged to support an outer member the outer member including a signal element, the signal element erected by a self-contained gas generating member.

30. The device of claim 29 wherein the outer member is constructed and arranged to expand into a pyramidal shaped body when the expandable member is fully inflated.

31. A self-erecting device comprising:

a base member;

a signal member;

a self-contained expandable member, the expandable member including a generating system constructed and arranged to erect the signal member; and a gas impervious inflatable member having opposing ends, the gas impervious inflatable member connected at opposing ends to an outer member providing the signal member, and the base member, the expandable member positioned in the gas impervious inflatable member;

whereby when the expandable member is activated, the gas impervious member expands to an elevated position and in turn expands the outer member to an elevated position.

32. The self-erecting device as defined in claim 31 wherein the gas impervious inflatable member is of a tubular configuration when inflated.

33. The self-erecting device as defined in claim 32 wherein the gas impervious flexible member is composed of polypropylene.

34. The self-erecting device as defined in claim 32 wherein the expandable member includes an aperture which permits gas to flow from the expandable member into the inflatable member.

35. The self-erecting device as defined in claim 32 wherein the expandable member includes a weakened portion to allow a gas to escape.

36. The self-erecting device as defined in claim 31 wherein the gas generating system includes a water activated material.

37. The self-erecting device as defined in claim 36 wherein the water activated material includes sodium bisulfate and sodium carbonate.

38. The self-erecting device as defined in claim 36 wherein the water and the water activated material are separated by a breachable member.

39. The self-erecting device as defined in claim 38 wherein the breachable member is provided by an inner sachet containing water and an outer sachet containing a water activated gas producing material.

40. The self-erecting device as defined in claim 31 wherein the signal member includes warning indicia.

41. The self-erecting device as defined in claim 31 wherein the base member is connected to a pad member tat can be saturated with a substance.

42. The self-erecting device as defined in claim 41 wherein the pad member has a sachet that is broken to saturate the pad member.

43. The self-erecting device as defined in claim 42 wherein the sachet contains a stain removing substance.

44. A method of cleaning up a stain on a surface while signaling its location comprising:

placing a pad member connected to a self-erecting device, the pad member connected to a sachet containing a stain removing substance on a stain;

and activating the self-erecting device and releasing the stain removing substances from the sachet and allowing the pad member saturated with the stain removing substance and attached to the self-erecting device to remain on the surface; and alternatively repeating the above steps until the stain is removed.

45. A combined cleaning and self-erecting device comprising:

a cleaning member including a pad of absorbent material;

a cleaning material contained in a breachable container, the breachable member connected to the pad; and a self-erecting device connected to the pad.

46. The device of claim 45 wherein the cleaning material is a liquid stain remover.

47. A self-erecting device comprising:

a base member;

a signal member;

a self-contained expandable member, the self-contained expandable material including a gas generating member comprising first and second breachable compartments containing gas producing materials when combined, the first and second compartments housed in a third compartment; and a gas impervious inflatable member having opposing ends, the gas impervious inflatable member connected at opposing ends to an outer member providing the signal member, and the base member; the expandable member positioned in the gas impervious inflatable member, the third compartment having an aperture to allow gas to enter the inflatable member;

whereby when the expandable member is activated, the gas impervious member expands to an elevated position and in turn expands the outer member to an elevated position.

48. The self-erecting device as defined in claim 47 wherein the inflatable member includes a weakened portion for tearing open the inflatable member.

49. The self-erecting device as defined in claim 47 wherein the second compartment surrounds the first compartment.

50. The device of claim 1 wherein the inflatable member is a tubular member with a sachet of liquid connected to one end thereof and a powdered material positioned at an opposite end.

51. The device of claim 50 wherein the powdered material is loosely placed in the tubular member.

52. The device of claim 50 wherein the liquid material is an acid material and the powdered material is a carbonate material.

53. The device of claim 50 wherein the liquid material is water and the powdered material is composed of an acid and carbonate powder.

54. The device of claim 50 wherein the inflatable material is centrally connected to the base and signal element.

* * * * *